US006464751B2

(12) United States Patent
Uenosono et al.

(10) Patent No.: US 6,464,751 B2
(45) Date of Patent: Oct. 15, 2002

(54) IRON-BASED POWDERS FOR POWDER METALLURGY

(75) Inventors: Satoshi Uenosono; Yukiko Ozaki, both of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/897,395

(22) Filed: Jul. 3, 2001

(65) Prior Publication Data

US 2002/0108468 A1 Aug. 15, 2002

(30) Foreign Application Priority Data

Oct. 6, 2000 (JP) ..... 2000-307802

(51) Int. Cl.[7] ..... B22F 1/00
(52) U.S. Cl. ..... 75/252
(58) Field of Search ..... 75/252

(56) References Cited

U.S. PATENT DOCUMENTS 5,256,185 A * 10/1993 Semel et al. ..... 75/255
5,429,792 A 7/1995 Luk
5,476,534 A * 12/1995 Ogura et al. ..... 75/252
5,989,304 A * 11/1999 Ozaki et al. ..... 75/252
6,235,076 B1 * 5/2001 Ozaki et al. ..... 75/252
6,355,208 B1 * 3/2002 Unami et al. ..... 419/11

FOREIGN PATENT DOCUMENTS

| | | |
|---|---|---|
| JP | 50-49107 | 5/1975 |
| JP | 59-59810 | 4/1984 |
| JP | 60-36602 | 2/1985 |
| JP | 3-162502 | 7/1991 |
| JP | 4-210402 | 7/1992 |
| JP | 60-2007 | 1/1994 |
| JP | 9-267195 | 10/1997 |

OTHER PUBLICATIONS

Kawasaki Steel Corporation, KIP Reduced Iron Powders Atomized Iron and Steel Powders, Feb. 1999, pp. 1–21.

* cited by examiner

*Primary Examiner*—Ngoclan Mai
(74) *Attorney, Agent, or Firm*—Oliff & Berridge, PLC

(57) ABSTRACT

An iron-based mixed powder for use in powder metallurgy has an apparent density of at least about 3.1 $Mg/m^3$, is excellent in die filling property and compressibility and without segregation, and includes an iron-based powder to which alloying powder is adhered at the surface by binder and free lubricant. The iron-based powder includes an atomized iron powder, or a mixed powder of an atomized iron powder and a reduced iron powder.

12 Claims, 2 Drawing Sheets

IRON-BASED POWDERS FOR POWDER METALLURGY

BACKGROUND OF THE INVENTION

1. Field of Invention

This invention is directed to iron-based mixed powders for use in metallurgy.

2. Description of Related Art

Iron-based mixed powders for use in powder metallurgy (hereinafter also referred to simply as "iron-based mixed powder") are manufactured, generally, by adding: (1) an iron powder for an iron-based powder as a substrate material (which can be a mixture of one or more kinds of iron powder); (2).alloying powder(s) (one or more kinds of alloying powder, such as a copper powder, graphite powder, iron phosphide powder); optionally, (3) a lubricant such as zinc stearate (which can be a mixture of one or more kinds of lubricant): and, optionally, (4) machinability improving powder(s) (one or more kinds of machinability improving powder).

However, the iron-based mixed powder described has a problem that the starting powder, particularly, the alloying powder(s) tends to cause segregation. This is because the iron-based mixed powder contains plural kinds of powder of different sizes, shape and density. Specifically, the distribution of starting powders in the iron-based mixed powder is not uniform during transportation after mixing, charging to a hopper, discharging from the hopper or upon charging to the mold or during pressing.

For example, it is well-known for the mixed powder of the iron powder and the graphite powder that the iron powder and the graphite powder move and displace independently of each other in a transportation container due to vibration during track transportation and, as a result, the graphite powder of lower specific gravity floats to the surface and causes segregation. Further, because the mixed powder of the iron powder and the graphite powder charged in the hopper segregates due to movement in the hopper, it is also well-known that the concentration of the graphite powder is different, for example, between each of the initial stage, the middle stage and the final stage, of discharging from the hopper.

When the segregated iron-based mixed powder is charged in a mold and pressed into a molding product and the molding product is finally sintered into a sintered body as a final product, the composition fluctuates for each product (sintered products). As a result of the fluctuation of the composition, the size and the strength of products vary greatly to cause failed products.

Further, because each of the alloying powders to be mixed, such as copper powder, graphite powder and iron phosphide powder is finer than the iron-based powder, the specific surface area of the iron-based mixed powder increases by the mixing of the alloying powder(s) to lower the fluidity of the iron-based mixed powder. Lowering the fluidity of the iron-based mixed powder lowers the charging rate of the iron-based mixed powder into the mold and, therefore, lowers the production speed of the molding product (also referred to as compact powder or green compact).

As the countermeasure for such problems in the iron-based mixed powder, particularly, as a technique for preventing segregation, Japanese Patent Laid-Open No. 219101/1989, for example, discloses an iron powder for use in powder metallurgy, comprising from 0.3 to 1.3% of a lubricant, from 0.1 to 10% of an alloying element powder and the balance of an iron powder, in which the alloying element powder is adhered on the surface of the iron powder. According to this publication, the iron powder for use in powder metallurgy causes no segregation of the ingredients during handling and enables to obtain homogeneous sintered products. Japanese Patent Laid-Open No. 219101/1989 discloses zinc stearate and lithium stearate as an example of the lubricant.

In Japanese Patent Laid-Open No. 162502/1991, the present inventors previously proposed a method of manufacturing an iron-based mixed powder for use in powder metallurgy with less segregation of additives and less aging change for the fluidity. The method described in Japanese Patent Laid-Open No. 162502/1991 comprises conducting primary mixing by adding a fatty acid to an iron-based powder, then conducting secondary mixing by adding a metal soap to the alloying powder(s), elevating temperature during or after the secondary mixing, and then applying cooling during tertiary mixing, thereby adhering the alloying powder(s) to the surface of the iron-based powder by a bonding effect of a co-molten product of the fatty acid and the metal soap.

Further, Japanese Patent Publication No. 3004800 discloses an iron-based mixed powder using a binder not containing a metal compound as a binder for the alloying powder(s) to the surface of the iron-based powder. It is described that contamination of a sintering furnace can be reduced by the use of the binder material not containing the metal compound.

However, the iron-based mixed powder applied with the segregation-preventive treatment by each of the publications described above involves a problem in the die filling property to a mold and, particularly, has a property that the amount of charge to a narrow width portion of the mold (thin-walled cavity) tends to be decreased. In view of the above, the present inventors have experimentally confirmed the die filling property of the iron-based mixed powder applied with the segregation-preventive treatment by the publications described above. First, the result of this experiment is explained.

2 mass % of a copper powder and 0.8 mass % of a graphite powder were mixed with an atomized iron powder as the iron-based powder as the alloying powder(s), and 0.4 parts by weight of zinc stearate and 0.2 parts by weight of machine oil (spindle oil) as the binder were mixed based on 100 parts by weight of the total amount for the iron powder and the alloying powder(s), and heated to adhere the alloying powder(s) to the surface of the iron powder (example of a binder treatment). Then, 0.3 parts by weight of zinc stearate was mixed with them as a free lubricant. An iron-based mixed powder as a mixture of an iron powder and a free lubricant in which alloying powder(s) is adhered on the surface of the iron powder (existent product) was obtained by this treatment. 150 g of the iron-based mixed powder was charged in a shoe box sized 100 mm×20 mm×60 mm, as shown in FIG. 1.

The shoe box was moved in the direction to a mold at a speed of 200 mm/sec, stood stationary just above the mold for 1 second and then retracted to the original position in the arrangement as shown in FIG. 1. The iron-based mixed powder was charged into the mold by the operation. The mold used has a cavity and a thickness of T mm, length L of 60 mm and depth D of 60 mm. The thickness T mm was varied as 1, 2 and 5 mm.

After charging, the iron-based mixed powder charged in the cavity was molded at a pressure of 488 MPa and the weight of the obtained molding product was measured. Then, the charged density (=molding product weight/mold volume) was calculated to evaluate the die filling property of the iron-based mixed powder to the mold. The result for the iron-based mixed powder (known product) is shown in FIG. 2. It can be seen from FIG. 2 that the charged density decreases as the cavity thickness T of the mold decreases in the known product. For example, when the cavity thickness T of the mold is 1 mm, the known iron-based mixed powder is charged by less than one-half of the apparent density. As described above, when the cavity thickness of the mold is thin, die filling property of the iron-based mixed powder treated for segregation by the related art is deteriorated.

In the known product having low die filling property as described above, when it is charged into a mold, for example, of a gear shape, the charged density is lower at a narrow width portion of the tooth tip as compared with other portions. Then, when it is pressurized into the molding product and further sintered, because the amount of shrinkage differs depending on the portions, the dimensional accuracy of the part is deteriorated. Generally, when the charged density is different and the green density is different in different portions, the rate of dimensional change upon sintering also differs and, further, the sintering density is also different. Accordingly, in the portion at the tooth tip of the gear of low charged density, the sintering density tends to be lowered and, thus, the strength is lowered. Because maximum stress usually exerts on the portion of the tooth tip in the gear, it is required that the portion of the tooth tip has a higher strength and, preferably, the charged density is higher.

In view of the problems described above, Japanese Patent Laid-Open No. 267195/1997 discloses, for example, a powder charging method comprising disposing a pipe having a gas releasing holes at the surface in a shoe box, fluidizing a powder by the gas exiting from the gas releasing holes, and then charging the powder gravitationally into the cavity. However, because the technique described in Japanese Patent Laid-Open No. 267195/1997 requires a special apparatus, it has the problems of increasing the installation cost and increasing the manufacturing cost.

Further, in the field of sintered parts for use in automobiles, for instance, reduction of size for sintered parts has been desired along with a demand for a weight reduction of car bodies in recent years. However, stress exerted on parts tends to be increased along with the size reduction of the parts. Accordingly, for parts of an identical composition, those parts of higher strength, namely, those parts of higher density are desired (for the sintered product of an identical composition, the strength is generally increased as the density is increased). In order to obtain a sintered part of a reduced size and having high density, it is necessary that the iron-based mixed powder is applied with the segregation-preventive treatment and be excellent in compressibility. In addition, it is required for an iron-based mixed powder that it is excellent in die filling property to the narrower width portion of the mold, as well as that it has the characteristics described above.

SUMMARY OF THE INVENTION

This invention can advantageously overcome the problems in the related art described above and provide an iron-based mixed powder capable of manufacturing sintered parts of consistently high density and with less fluctuation of characteristics. Specifically, the invention can provide an iron-based mixed powder applied with a segregation-preventive treatment and excellent in the compressibility (high density for the molding product) and excellent in die filling property.

The present inventors have made an earnest study, in order to solve the foregoing problems, of various factors affecting the compressibility and the die filling property of the iron-based mixed powder applied with the segregation-preventive treatment (for example, a binder treatment).

For obtaining a high sintered density required generally for sintered parts, an atomized iron powder excellent in compressibility and fluidity of the mixed powder has usually been used as the iron-based powder. However, according to the study of the present inventors, it has been found that the iron-based mixed powder using the atomized iron powder as the iron-based powder is poor in die filling property to a mold having a narrow cavity compared with the iron-based mixed powder using a reduced iron powder. It is well known that mixed powder including reduced iron powder is inferior to that using atomized iron powder, not only in compressibility, but also in fluidity (measured by flow rate). Accordingly, it is an unexpected result that the mixed powder using the reduced iron powder shows high die filling property. However, it is difficult to obtain sufficient compressibility in the iron-based mixed powder using the reduced iron powder.

In view of the above, the present inventors further made a study on the reasons why the mixed powder using the reduced iron powder shows a high die filling property. Then, as a result of a further study noting that the distribution of the particle size is different between the reduced iron powder and the atomized iron powder, it has been found that the particle size distribution of the iron-based powder significantly affects the die filling property of the mixed powder.

Then, the present inventors have discovered that the die filling property can be improved remarkably in a case of using the atomized iron powder alone, or in a case of using an iron-based powder mainly comprising an atomized iron powder mixed with a reduced iron powder by forming an iron-based mixed powder using an iron-based powder having a predetermined particle size distribution, which is more restricted than that of conventional atomized iron powder. On the other hand, the present inventors have also discovered that the compressibility and the die filling property can be compatibilized by ensuring that the apparent density of the atomized iron powder and the iron-based mixed powder are more than a predetermined value. The present inventors have further discovered that use of appropriate binder and lubricant can also contribute to the further improvement of the die filling property. By the application of such discoveries, the present inventors have successfully obtained an iron-based mixed powder excellent in compressibility and remarkably improved in its die filling property.

FIG. 2 shows the die filling property of an iron-based mixed powder according to this invention as the product of the invention. The iron-based mixed powder according to this invention (inventive product) can be charged well even for a cavity having a thickness of 1 mm, and it can be seen that the die filling property is remarkably improved as compared with the known product.

This invention has been accomplished based on the findings described above and as a result of further study.

That is, this invention provides an iron-based mixed powder for use in powder metallurgy having an apparent density of at least about 3.1 $Mg/m^3$, which comprises an iron-based powder, alloying powder(s), a binder and, optionally, machinability improving powder(s) and, preferably, further containing a free lubricant. The alloying powder(s) and, optionally, the machinability improving powder(s) are adhered by the binder to the surface of the iron-based powder (or applied with a binder treatment for adhesion). The iron-based powder is an atomized iron powder or a mixed powder of an atomized iron powder and the reduced iron powder, and with a maximum particle size of less than about 180 μm, and with a particle size distribution containing 18.5 mass % or less of particles with a particle size of less than about 45 μm, 46 mass % or more of particles with a particle size of from about 75 μm to about 150 μm, and less than 10 mass % of particles with a particle size of from about 150 μm to about 180 μm, and the apparent density of the atomized iron powder is at least about 2.85 $Mg/m^3$.

Further, in this invention, the content of the binder is preferably from about 0.1 parts by weight to about 1.0 parts by weight based on 100 parts by weight of the total amount for the iron-based powder, alloying powder(s) and the machinability improving powder(s).

Further, in this invention, the binder is preferably one or more members selected from stearic acid, oleamide, stearamide, a melted mixture of stearamide and ethylenbis (stearamide) and ethylenbis(stearamide).

Further, in this invention, the binder may comprise one or more members selected from oleic acid, spindle oil and turbine oil, and zinc stearate.

Further, in this invention, the content of the free lubricant is preferably from about 0.1 parts by weight to about 0.5 parts by weight based on 100 parts by weight of the total amount for the iron-based powder, the alloying powder(s) and the machinability improving powder(s).

Furthermore, in this invention, the free lubricant preferably contains one or more members selected from a thermoplastic resin powder, zinc stearate and lithium stearate, or, optionally, contains one or more members selected from stearic acid, oleamide, stearamide, a melted mixture of stearamide and ethylenbis(stearamide), ethylenbis (stearamide), polyethylene with a molecular weight of about 10,000 or less, and a melted mixture of ethylenbis (stearamide) and polyethylene with a molecular weight of about 10,000 or less.

Further in this invention, the thermoplastic resin powder preferably comprises at least about 50 mass %, based on the thermoplastic powder, of at least one member selected from acrylic esters, methacrylic esters and the aromatic vinyl compounds as a monomer polymerized therewith, and has a average primary particle size of from about 0.03 μm to about 5.0 μm, an average agglomeration particle size of from about 5 μm to about 50 μm, and an average molecular weight, measured by a solution specific viscosity method, of from about 30,000 to about 5,000,000.

DETAILED DESCRIPTION OF PREFERRED EMBODIMENTS

Figure 1:
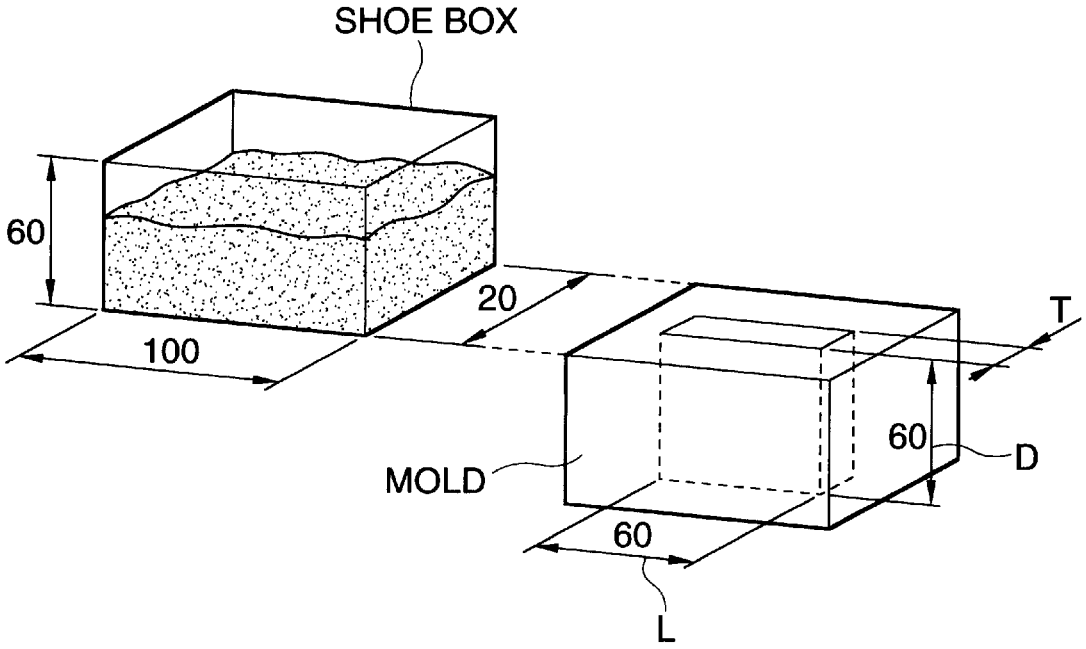
FIG. 1 is a schematic explanatory view showing a test apparatus for a die filling property test.
Figure 2:
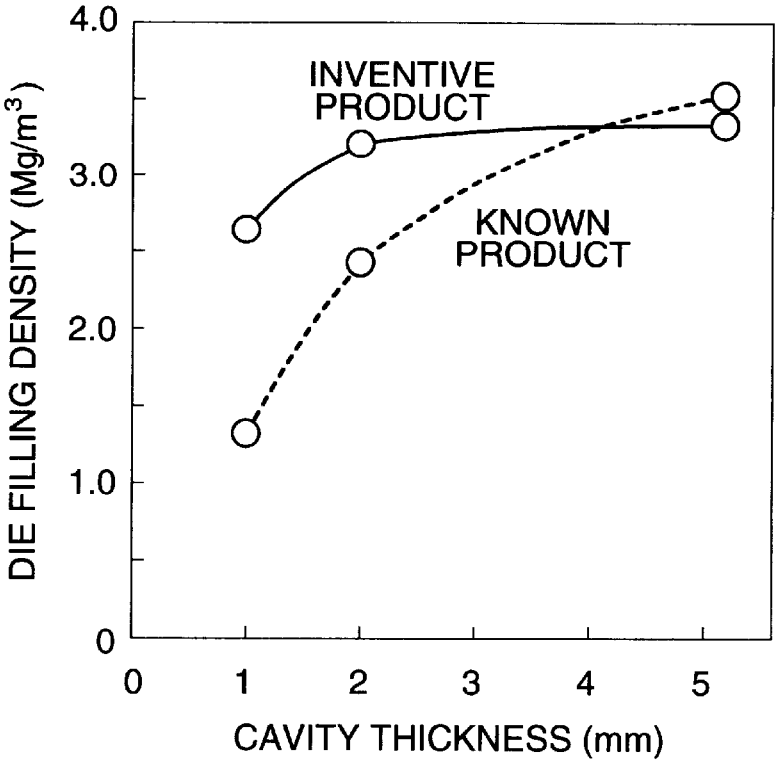
FIG. 2 is a graph illustrating the relationship between the die filling property density and the cavity thickness of a mold for a iron-based mixed powder of known iron-based mixed powder (known product) and iron-based mixed powder according to this invention (inventive product)

The iron-based mixed powder for use in powder metallurgy according to this invention is an iron-based mixed powder having an apparent density of at least about 3.1 $Mg/m^3$, which comprises an iron-based powder, alloying powder(s), a binder(which can be a mixture of one or more kinds of binder) and, optionally, a lubricant and, further optionally, machinability improving powder(s), in which the alloying powder(s) and, optionally, the machinability improving powder(s) are adhered by the binder to the surface of the iron-based powder as a segregation-preventive treatment. Both die filling property and compressibility can be excellent by increasing the apparent density of the iron-based mixed powder to 3.1 $Mg/m^3$ or more.

The iron-based powder used for the iron-based mixed powder according to this invention is an iron powder, having particles with a maximum particle size of less than about 180 μm, and having a particle size distribution containing 18.5 mass % or less of particles with a particle size of less than about 45 μm, at least about 46 mass % of particles with a particle size of from about 75 μm to about 150 μm, and less than about 10 mass % of particles with a particle size of from about 150 μm to about 180 μm.

Excellent die filling properties can be obtained by defining the maximum particle size, the content of the particles with a particle size of less than about 45 μm, the content of the particles with a particle size of from about 75 μm to about 150 μm, and the content of the particles with a particle size of from about 150 μm to about 180 μm, within the range as described above. In this invention, because the particles with a particle size of from about 45 μm to about 75 μm have no significant effect on the die filling property and the compressibility, the content of the particles with a particle size of from about 45 μm to about 75 μm is not particularly limited.

A "maximum particle size of less than 180 μm" means that when the iron powder is sieved and selected on every particle size, the content of iron powder particles having a size of 180 μm or more is negligible in amount. Iron powder in which the content of particles having a size of 180 μm or more is less than about 1 mass %, possibly satisfies the limitation. The content of about 0.5 mass % or less is more preferable, and the content of about 0.1 mass % or less is even more preferable.

Further, with a view point of further improving the die filling property, the content of the particles with a particle size of from about 75 μm to about 150 μm is preferably at least about 48 mass % and, further preferably, at least about 50 mass %, in the particle size distribution of the iron-based powder described above. Further, it is also preferred to further improve the die filling property that the particles with a particle size of less than about 45 μm are less than about 15 mass % and, further preferably, less than about 12.7 mass %. For the particle size distribution of the iron-based powder used in this invention, a value measured by a sieve distribution method (JPMA P02-1992, Standards of Japan Powder Metallurgy Industry Society) is adopted.

In this invention, for the iron-based powder used for the iron-based mixed powder, it is preferred to use an atomized iron powder, or a mixed iron powder of an atomized iron powder and a reduced iron powder, with respect to the compressibility and the die filling property. In any of the iron powder, die filling property of the iron-based mixed powder is improved remarkably by controlling the particle size distribution to that described above.

In order to obtain an iron-based powder having a particle size distribution described above, it is preferred to classify the iron-based powder used (for example, commercially available atomized iron powder) with a sieve and then blend the same so as to provide the particle size distribution described above. In a case of using a mixed powder of the atomized iron powder and the reduced iron powder as the iron-based powder, they may be classified by a sieve as required respectively and then blended so as to provide the particle size distribution described above.

When the reduced iron powder is blended, the blending amount of the reduced iron powder is controlled in accordance with the desired density for the applied parts so as to maintain satisfactory compressibility of the iron-based mixed powder. Usually, the blending amount of the reduced iron powder is preferably 40 mass % or less based on the entire amount of the iron-based powder in order to maintain satisfactory compressibility. When the amount of the reduced iron powder is 40 mass % or less, the compressibility of the obtained iron-based mixed powder causes no significant lowering. Further, for the reduced iron powder to be blended, 30 mass % or less based on the entire amount of the iron-based powder may be mixed with no problems after the binder treatment. By this treatment, the reduced iron powder is present in the iron-based mixed powder as an iron powder having neither alloying powder(s) nor machinability improving powder(s) adhered on the surface thereof (hereinafter referred to as "free iron-based powder"). The die filling property is further improved in such iron-based mixed powder.

When the mixed iron powder of the atomized iron powder and the reduced iron powder is used in this invention, the atomized iron powder and the reduced iron powder may be merely mixed, and it is not necessary that these powders are metallurgical bonded.

The atomized iron powder used as the iron-based powder in this invention is an iron powder having an apparent density of 2.85 $Mg/m^3$ or more, preferably, 2.90 $Mg/m^3$ or more. A satisfactory die filling property is ensured in the iron-based mixed powder by defining the apparent density to be 2.85 $Mg/m^3$ or more and, preferably, 2.90 $Mg/m^3$ or more.

The atomized iron powder mainly used as the iron-based powder in this invention is, preferably, a pure iron powder manufactured from molten metal by an atomizing method.

Further, for the reduced iron powder used in addition to the atomized iron powder as the iron-based powder, reduced iron powder made of mill scales formed upon manufacture of steel materials, or made of iron ores, is preferably used. The apparent density of the reduced iron powder may be such that a predetermined apparent density for the iron-based mixed powder (3.1 $Mg/m^3$ or more) can be obtained. Particularly, an apparent density value of from about 1.7 $Mg/m^3$ to about 2.8 $Mg/m^3$ is preferred. A value for the apparent density of from about 2.5 $Mg/m^3$ to about 2.8 $Mg/m^3$ is even more preferable.

Further, the alloying powder(s) is mixed with the iron-based mixed powder in accordance with desired mechanical characteristics of the sintered product, and various kinds of alloy powders, such as graphite powder, copper powder and nickel powder are preferably used as the alloying powder(s).

The content of the alloying powder(s) is preferably about 5.0 mass % or less based on the total amount including the iron-based powder, alloying powder(s) and the machinability improving powder(s) mixed optionally to ensure high green density.

Further, when it is necessary to improve the machinability of the sintered product, machinability improving powder(s) is mixed with the iron-based mixed powder. For the machinability improving powder(s), a talc powder, a metal sulfide powder, or the like, is selected in view of the physical property required for the sintered product. The content of the machinability improving powder(s) is preferably about 5.0 mass % or less based on the total amount of the iron-based powder, the alloying powder(s) and the machinability improving powder(s) to ensure a high green density.

Further, in the iron-based mixed powder, a binder is mixed for adhering the alloying powder(s) and, optionally, the machinability improving powder(s) on the surface of the iron-based powder and for preventing segregation.

In this invention, the content of the binder is preferably from about 0.1 parts by weighi to about 1.0 parts by weight based on 100 parts by weight of the total amount for the iron-based powder, the allying powder(s) and the machinability improving powder(s). That is, the binder is preferably used in an amount of about 0.1 parts by weight or more for adhering treatment capable of effectively preventing segregation of the alloying powder(s) (binder treatment), and the binder is used preferably in an amount of about 1.0 part by weight or less for maintaining the die filling property of the iron-based mixed powder satisfactorily.

In this invention, the binder used preferably includes one or more members selected from stearic acid, oleamide, stearamide, a melted mixture of stearamide and ethylenbis (stearamide) and ethylenbis(stearamide) (binder A). The binder A used preferably may be one or more members selected from stearic acid, oleamide, stearamide, a melted mixture of stearamide and ethylenbis(stearamide) and ethylenbis(stearamide), which is melted under heating.

Further, in this invention, a binder comprising zinc stearate and one or more members selected from oleic acid, spindle oil and the turbine oil may be used (binder B). As the binder B, zinc stearate and one or more members selected from oleic acid, spindle oil and turbine oil, which are melted by heating may be used.

Further, the iron-based mixed powder is usually mixed with a lubricant to improve the fluidity of the iron-based mixed powder and the die filling property to the mold, as well as with an aim of lowering the ejection force by being melted or softened by the heat of friction upon pressing the iron-based mixed powder in a mold.

For obtaining such an effect of the lubricant, it is necessary that at least some amount of the lubricant is present as a free lubricant. The "free lubricant" described herein means a lubricant not bonded with the iron-based powder (iron powder), the alloying powder(s), or the machinability improving powder(s) in the iron-based mixed powder, but is present in a free state. The content of the free lubricant is preferably from about 0.1 parts by weight to about 0.5 parts by weight based on 100 parts by weight of the total amount for the iron-based powder, alloying powder(s) and the machinability improving powder(s). When the free lubricant is contained in an amount of about 0.1 parts by weight or more, the die filling property of the iron-based mixed powder can be improved further. When the content of the free lubricant is 0.5 parts by weight or less, satisfactory die filling property and high molding product density can be maintained.

In this invention, use of one or more members selected from a thermoplastic resin powder, zinc stearate and lithium stearate as the free lubricant is preferred. As the free lubricant, it is preferred to use one or more members selected from a thermoplastic resin powder, zinc stearate and lithium stearate, incorporated further with one or more members selected from stearic acid, oleamide, stearamide, a melted mixture of stearamide and ethylenbis(stearamide), ethylenbis(stearamide), polyethylene with a molecular weight of about 10,000 or less and a melted mixture of ethylenbis(stearamide) and a polyethylene with a molecular weight of about 10,000 or less.

When one or more members selected from thermoplastic resin, zinc stearate and lithium stearate is incorporated as the free lubricant, the die filling property of the iron-based mixed powder is improved remarkably. Further, the content of one or more of members selected from thermoplastic resin, zinc stearate and lithium stearate is preferably about 0.05 parts by weight or more, more preferably, from about 0.1 parts by weight to about 0.5 parts by weight based on 100 parts by weight of the total amount for the iron-based powder, alloying powder(s) and the machinability improving powder(s) (added optionally) in view of the improvement for the fluidity and the die filling property into the mold of the iron-based mixed powder.

Further, the thermoplastic resin powder preferably contains about 50 mass % or more of at least one member selected from acrylic esters, methacrylic esters and aromatic vinyl compounds (each as monomer) based on the entire amount of the thermoplastic resin powder, which is polymerized therewith. When the content of at least one member selected from acrylic esters, methacrylic esters and aromatic vinyl compounds as the monomer is about 50 mass % or more based on the entire amount of the thermoplastic resin powder, the fluidity of the iron-based mixed powder is improved sufficiently. As the monomer, one of the acrylic esters, methacrylic esters and aromatic vinyl compounds may be used alone, or two or more of them may be used in combination.

The acrylic ester can include, for example, methyl acrylate, ethyl acrylate, n-propyl acrylate, isopropyl acrylate, n-butyl acrylate, isobutyl acrylate, sec-butyl acrylate, t-butyl acrylate, n-hexyl acrylate, cyclohexyl acrylate, 2-ethylhexyl acrylate and n-octyl acrylate.

Further, the methacrylic ester can include, for example, methyl methacrylate, ethyl methacrylate, n-propyl methacrylate, isopropyl methacrylate, n-butyl methacrylate, isobutyl methacrylate, n-hexyl methacrylate, cyclohexyl methacrylate, 2-ethylhexyl methacrylate and n-octyl methacrylate. Among the monomers described above, methyl methacrylate can be used particularly suitably.

Further, the aromatic vinyl compound can include, for example, monomers such as styrene, α-methylstyrene and divinylbenzene. Further, monomers having a methyl group, ethyl group, propyl group or butyl group substituted on the benzene ring of the monomer described above, for example, vinyl toluene or isobutyl styrene can also be included in the aromatic vinyl compound.

Further, at least one monomer selected from acrylic esters, methacrylic esters and aromatic vinyl compounds may be incorporated and copolymerized with other copolymerizable monomer in an amount preferably of about 50 mass % or less based on the entire amount of the monomer to form a thermoplastic resin.

Other monomers copolymerizable with the three kinds of monomers described above can include, for example, unsaturated monomocarboxylic acids, such as acrylc acid, methacrylic acid, 2-ethyl acrylic acid, crotonic acid, and cinnamic acid; unsaturated dicarboxylic acid, such as maleic acid, itaconic acid, fumaric acid, citraconic acid, and chloromaleic acid, as well as anhydrides thereof, monoesters of unsaturated dicarboxylic acids such as monomethyl maleate, monobutyl maleate, monomethyl fumarate, monoethyl fumarate, monomethyl itaconate, monoethyl itaconate and monobuthyl itaconate, as well as derivatives thereof; glycidyl ethers, such as glycidylmethacrylate, glycidylacrylate, glycidyl-p-vinylbenzoate, methylglycidylitaconate, ethylglycidylmaleate and glycidylvinylsulfonate; epoxide olefins, such as butadiene monoxide, vinylcyclohexene monoxide, 5,6-epoxyhexene, and 2-methyl-5,6-epoxyhexene; vinyl cyanides, such as acrylonitrile and methacrylonitrile; vinyl esters, such as vinyl acetate, vinyl propionate, vinyl myristate, vinyl oleate and vinyl benzoate; conjugated diene compounds, such as budadiene, isoprene, 1,3-pentadiene and cyclopentadiene; and non-conjugated diene compounds, such as 1,4-hexadiene, dicyclopentadiene and ethylidenenorbornene.

Further, as the copolymerizable monomer, a crosslinking monomer having two or more double bonds substantially equal in reactivity may be added in an amount of from about 0.1 to about 2 mass % based on the entire amount of the monomer. The crosslinking monomer can include, for example, ethyleneglycol diacrylate, ethyleneglycol dimethacrylate, butyleneglycol diacrylate, butyleneglycol dimethacrylate, trimethylolpropane diacrylate, trimethylolpropane dimethacrylate, trimethylolpropane triacrylate, trimethylolpropane trimethacrylate, hexanediol diacrylate, hexanediol dimethacrylate, oligoxyethylene diacrylate and oligoxyethylene dimethacrylate, as well as aromatic divinyl monomers, such as divinylbenzene, triallyl trimeritate and triallyl isocyanurate.

The thermoplastic resin powder described above preferably has an average primary particle size of from about 0.03 μm to about 5.0 μm, an average agglomeration particle size of from about 5 μm to about 50 μm, an average molecular weight, as measured by a solution specific viscosity method, of from about 30,000 to about 5,000,000.

Figure 3:
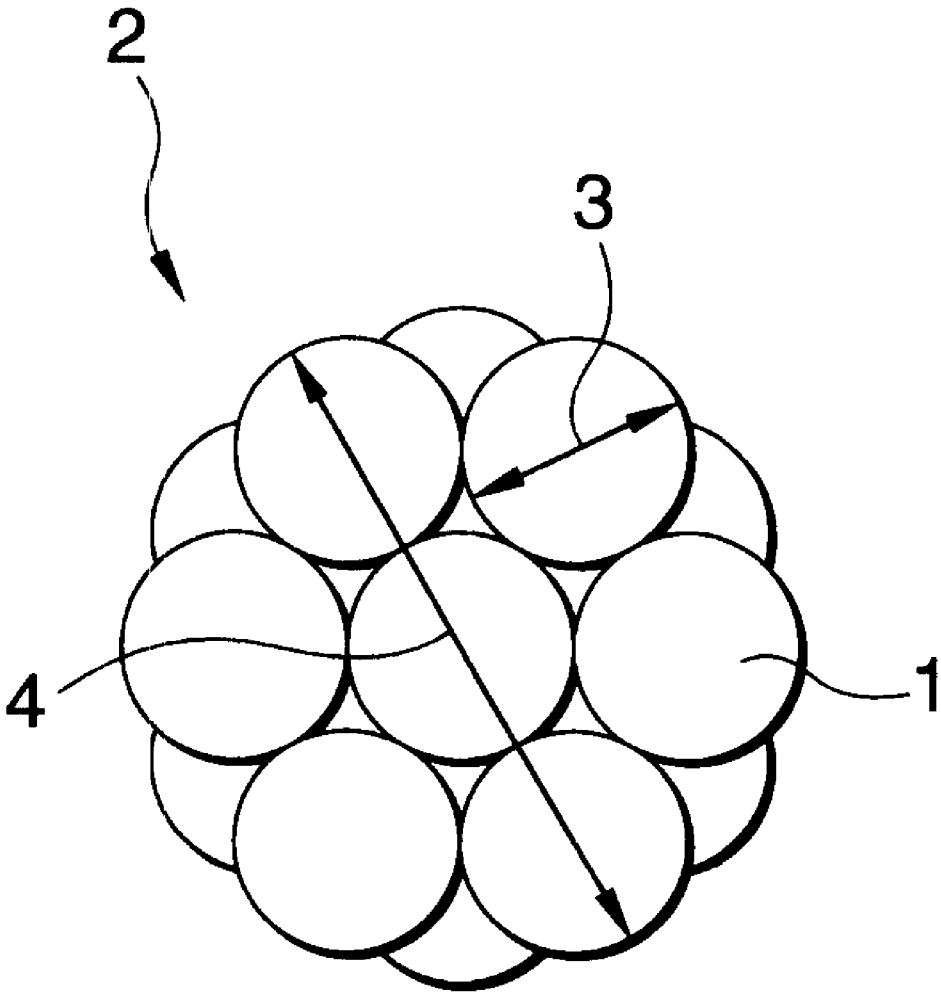
FIG. 3 is an explanatory view illustrating the definition for the primary particle size and the agglomeration particle size.

The average primary particle size referred to in this invention means an average value for the particle size 3 of individual particles (primary particles 1) of the thermoplastic resin powder as shown in FIG. 3. Further, the average agglomeration particle size means an average value for the particle size 4 of the agglomerated particle 2 formed by cohesion of the primary particles 1. The average primary particle size is obtained by observing agglomerated particles by a scanning electron microscope (SEM), actually measuring the diameter (primary particle size) for about 50 of the primary particles forming the agglomerated particle based on the SEM photograph and averaging the same. Further, the average agglomeration particle size is obtained by observing the agglomerated particle by the scanning electron microscope in the same manner and measuring the particle size for about 50 of the agglomerated particles based on the SEM photograph and averaging the same.

Further, in this invention, the average molecular weight is measured by a solution specific viscosity method. Measurement by the solution specific viscosity method is conducted by the following procedures. 0.2 g of a specimen resin is dissolved in 50 ml of tetrahydrofuran to determine the viscosity A of the solution at 35° C. In the same manner, the viscosity B of a solvent (tetrahydrofuran) at an identical temperature is determined to calculate a specific viscosity (A/B). Because the relation for the specific viscosity - average molecular weight is previously determined from various kinds of standard polystyrenes, the average molecular weight of which is known, the average molecular weight of the specimen resin is determined based on the specific viscosity described above using the relation.

The average primary particle size of the thermoplastic resin powder is preferably from about 0.03 μm to about 5.0

μm. When the average primary particle size is about 0.03 μm or more, the manufacturing cost of the resin powder is not expensive, so that the production cost for the iron-based mixed powder can be prevented from increasing. The average primary particle size is further preferably about 0.05 μm or more. Further, when the size is defined as about 5.0 μm or less, the density of the molding product can be kept high (that is, the compressibility can be maintained satisfactorily). The size is further preferably about 3.0 μm or less.

The average agglomeration particle size of the thermoplastic resin powder is preferably from about 5 μm to about 50 μm. When the average agglomeration particle size is about 5 μm or more, the fluidity and the hopper dischargeability of the iron-based mixed powder can be maintained satisfactory. This size is further preferably about 10 μm or more. Further, when this size is about 50 μm or less, the tensile strength of the sintered product can be kept equal or greater than that of the known product. This size is further preferably about 40 μm or less.

Further, as the thermoplastic resin powder, two or more kinds of thermoplastic resin powders of different average primary particle size can be mixed. In this case, the mixing ratio is preferably controlled, such that the average primary particle size of the mixed powder can satisfy the preferred condition for the average primary particle size described above.

Further, the average molecular weight of the thermoplastic resin powder measured by the solution specific viscosity method is preferably from about 30,000 to about 5,000,000. When the average molecular weight is about 30,000 or more, the manufacturing cost of the resin powder is not expensive and the production cost of the iron-based mixed powder can be prevented from increasing. Further, when the average molecular weight is about 5,000,000 or less, the fluidity or the hopper dischargeability of the iron-based mixed powder can be maintained substantially equal to or greater than that of the known product.

There is no particular restriction on the manufacturing method of the thermoplastic resin powder described above and any of several methods used so far for the manufacture of fine resin powder, such as of polymethyl methacrylate is suitable. Among the methods, a polymerization method of not reducing the particle size to extremely fine size and capable of obtaining spherical particles, for example, a micro-suspension polymerization method, an emulsion polymerization method and a seeding emulsion polymerization method are particularly preferred.

As the micro-suspension polymerization method, it is suitable to use a method of using an oil soluble initiator as a radical polymerization initiator, previously controlling the particle size of monomer oil droplets by homogenization (into uniformity) before starting of the polymerization, and conducting polymerization in a homogeneously dispersed state.

The oil soluble radical polymerization initiator usable herein can include, for example, benzoyl peroxide, diacyl peroxides such as di-3,5,5-trimethylhexanoyl peroxide and dilauloyl peroxide; peroxydicarbonates, such as diisopropylperoxy dicarbonate, di-sec-butylperoxy dicarbonate, and di-2-ethylhexylperoxy dicarbonate; peroxyesters, such as t-butylperoxypivalate and t-butylperoxyneodecanoate; organic peroxides, such as acetylcyclohexylsulfonyl peroxide and disuccinic acid peroxide; and azo compounds such as 2.2'-azobisisobutyronitrile, 2,2'-azobis-2-methylbutyronitrile, and 2,2'-azobisdimethylvaleronitrile.

Further, such radical polymerization initiators may be used alone, or two or more initiators may be used in combination. The amount of use can be properly selected depending on the kind and the amount of the monomer and the charging method and usually it is preferably used within a range from about 0.001 to about 5.0 parts by weight based on 100 parts by weight of the monomer used.

When the micro-suspension polymerization method is practiced, a surface active agent (surfactant) and a dispersant agent are used usually.

The surface active agent can include, for example, anionic surface active agents, for example, alkyl sulfate such as sodium lauryl sulfate and sodium myristyl sulfate; alkylaryl sulfonates, such as sodium dodecylbenzene sulfonate and potassium dodecylbenzene sulfonate; sulfosuccinates, such as sodium dioctylsulfosuccinate and sodium dihexylsulfosuccinate; salts of fatty acides, such as ammonium laurate and potassium stearate; polyoxyethylenealkylsulfate; polyoxyethylenealkylarylsulfate; anionic surfactants such as sodium dodecyldiphenyletherdisulfonate; sorbitan esters, such as sorbitanmonooleate, polyoxyethylenesorbitanmonostearate; polyoxyethylenealkylether, nonionic surfactants such as polyoxyethylenealkylphenylether, and cationic surfactants such as cetylpyridinium chloride and cetyltrimethylammonium bromide.

The dispersant can include, for example, polyvinylalcohol, methylcellulose and polyvinylpyrrolidone.

Such surface active agent and dispersant may be used alone, or two or more of these may be used in combination. The amount of use can properly be selected usually within a range of from about 0.05 to about 5 parts by weight, preferably, from about 0.2 to about 4 parts by weight based on 100 parts by weight of the monomer used.

Further, in the micro-suspension polymerization method, an oil soluble initiator, a monomer, a surface active agent, as well as polymerization aiding agent, such as higher fatty acids or higher alcohols used optionally and other additives are at first added to an aqueous medium and mixed previously, subjected to homogenization by a homogenizer to conduct particle size control for oil droplets.

As the homogenizer, for example, a colloid mill, a vibration stirrer, a two-stage high pressure pump, high pressure flow from a nozzle or orifice, and supersonic stirring can be utilized. In addition, for control of the oil droplet particle size, appropriate conditions can be selected by a simple preliminary experiment, while this is being effectuated depending on the control for the shearing force upon homogenization, stirring condition during polymerization, reactor type and the amount of the surface active agent and the additives. Then, the homogenization treated solution of the entire monomer is sent to a polymerization vessel and, while elevating the temperature under moderate stirring, polymerization is conducted usually at a temperature ranging from about 30° C. to about 80° C.

In this way, a liquid emulsion or liquid suspension in which thermoplastic resin powder particles having a desired value for the average primary particle size (for example, from 0.03 μm to 5.0 μm) are dispersed homogeneously can be obtained. After spray drying the liquid emulsion or the liquid suspension for cohesion of the thermoplastic resin particles, the liquid component is separated by filtration, dried and pulverized to obtain a thermoplastic resin powder. The weight average molecular weight of the thermoplastic resin may be controlled to a predetermined value by the reaction temperature or the polymerization degree controller.

Next, an example of the preferred manufacturing method of the iron-based mixed powder according to this invention is explained.

First, an atomized iron powder, or a mixed powder of an atomized iron powder and a reduced iron powder as the iron-based powder having the predetermined particle size distribution, alloying powder(s) and, optionally, machinability improving powder(s), and a binder are mixed to form a mixture. The binder is preferably mixed in an amount from 0.1 parts by weight to about 1.0 parts by weight or less based on 100 parts by weight of the total amount for the iron-based powder, the alloying powder(s) and the machinability improving powder(s). The binder is preferably one or more members selected from stearic acid, oleamide, stearamide, a melted mixture of stearamide and ethylenbis(stearamide) and ethylenbi s(stearamide).

The mixture is mixed under heating (the process up to this step is referred to as primary mixing). When one kind of binder is used, the heating temperature in the primary mixing is preferably at a temperature higher by about 10° C. to about 100° C. than the melting point of the binder. When two or more kinds of binder are used, the heating temperature is preferably at least about 10° C. higher than the lowest value of the melting points of the binders and lower than the highest value among the melting points of the binders. When heating is conducted at a temperature higher than the lower limit temperature described above, at least one kind of binder is melted to provide the binding function by the binder for the powder particles. Further, when the heating temperature is defined as lower than the upper limit described above, reduction of the binding function due to thermo-decomposition of the binder, or the like, can be avoided sufficiently and, the hopper dischargeability can be maintained satisfactorily.

Then, the primarily mixed powder is cooled to adhere the alloying powder(s) or the machinability improving powder (s) to the surface of the iron-based powder. The processing steps from the mixing of the starting material powders including the binder up to this step are generally referred to as the binder treatment or adhering treatment.

Then, a lubricant is further added to the primarily mixed powder in which the alloying powder(s) or, optionally, the machinability improving powder(s) are adhered on the surface of the iron-based powder and mixed (referred to as secondary mixing) to form an iron-based mixed powder. The temperature for the secondary mixing is preferably lower than the lowest value among the melting points of the lubricants to be added for obtaining the lubrication function. The temperature is more preferably at a room temperature. Further, the amount of the lubricant to be added is preferably from about 0.1 parts by weight to about 0.5 parts by weight, based on 100 parts by weight of the total amount for a the iron-based powder, the alloying powder(s) and the machinability improving powder(s) (added optionally). The lubricant added by the secondary mixing forms a free lubricant and is present in a free state not bonded with the iron-based powder in the mixed powder.

The lubricant added upon secondary mixing as the free lubricant comprises one or more members selected from thermoplastic resin powder, zinc stearate and lithium stearate described above and, optionally, comprises one or more members selected from stearic acid, oleamide, stearamide, a melted mixture of stearamide and ethylenbis(stearamide), ethylenbis(stearamide), polyethylene with a molecular weight of about 10,000 or less, a melted mixture of ethylenbis(stearamide) and polyethylene with a molecular weight of about 10,000 or less. The thermoplastic resin powder preferably comprises about 50 mass % or more, based on the entire amount of the thermoplastic resin powder, of at least one compound selected from acrylic esters, methacrylic esters and aromatic vinyl compounds as the monomer which is polymerized therewith.

In this invention, the reduced iron powder can be mixed as a portion of the iron-based powder and, when the reduced iron powder is mixed, a portion of reduced iron powder, preferably, less than about 30 mass %, based on the entire amount of the iron-based powder, may be added during secondary mixing. This can make the reduced iron powder added upon secondary mixing as a free iron-based powder having no alloying powder(s) or machinability improving powder(s) adhered on the surface. When at least a portion of a reduced iron powder is a free iron-based powder, the die filling property of the iron-based mixed powder can be improved further remarkably.

Further, as another manufacturing method, the iron-based mixed powder according to this invention can be manufactured also by the following steps (1)-(4).

(1) After adding alloying powder(s) and, optionally, machinability improving powder(s), to an iron-based powder (either atomized iron powder or a mixture of atomized iron powder and reduced iron powder) controlled to a predetermined particle size distribution and further spraying a liquid binder to such powders (the liquid binder is hereinafter referred to as a spray binder), they are mixed. As a liquid binder, one or more of oleic acid, spindle oil and turbine oil is preferably used.

(2) Zinc stearate is further added and mixed with the mixture to form a primary mixture. The amount of the zinc stearate, together with the spray binder, is preferably from about 0.1 to about 1.0 parts by weight based on 100 parts by weight of the total amount for the iron-based powder, the alloying powder(s) and the machinability improving powder (s).

(3) The primary mixed powder is subjected to secondary mixing under heating at a temperature of from about 110° C. to about 150° C. A molten product by heating of zinc stearate and at least one of the spray binder is formed by the heating. When the heating temperature for secondary mixing is about 110° C. or higher, the function of the binder is fully provided to prevent segregation of the alloying powder(s). Further, when the heating temperature is about 150° C. or lower, lowering of the compressibility due to oxidation (hardening) of the iron-based powder can be prevented sufficiently from lowering.

Then, when the secondary mixed powder is cooled, the alloying powder(s) and, optionally, the machinability improving powder(s) are adhered firmly to the surface of the iron-based powder.

(4) A lubricant is further added to the secondary mixed powder in which the alloying powder(s) and, optionally, the machinability improving powder(s), are adhered to the surface of the iron-based powder and subjected to tertiary mixing to form an iron-based mixed powder.

The temperature for the tertiary mixing is preferably lower than the lowest value of the melting points of the lubricants to be added. It is more preferably at a room temperature.

Further, the amount of the lubricant to be added is preferably from about 0.1 to about 0.5 parts by weight based on 100 parts by weight of the total amount for the iron-based powder, the alloying iron powder and the machinability improving powder(s). The lubricant added in the tertiary mixing forms a free lubricant, which is not substantially bonded with the iron-based powder and is present in a free state in the mixed powder.

The lubricant added in the tertiary mixing is preferably a lubricant, which contains one or more of members selected from thermoplastic resin powder, zinc stearate and lithium stearate described above and, optionally, contains one or more of members selected from stearic acid, oleamide, stearamide, a melted mixture of stearamide and ethylenbis (stearamide), ethylenbis(stearamide), polyethylene with a molecular weight of about 10,000 or less, a melted mixture of ethylenbis(stearamide) and polyethylene with a molecular weight of about 10,000 or less. The thermoplastic resin powder preferably contains about 50 mass % or more, based on the entire amount of the thermoplastic resin powder, of at least one compound selected from acrylic esters, methacrylic esters and aromatic vinyl compounds as a monomer polymerized therewith.

In the example of the manufacturing method described above, the treatment (1)–(3) constitutes the binder treatment.

In this invention, the reduced iron powder can be mixed as a portion of the iron-based powder and, when the reduced iron powder is mixed, a portion of the reduced iron powder, preferably, about 30 mass % or less thereof based on the entire amount of the iron-based powder may be added upon tertiary mixing. This can make the reduced iron powder added upon tertiary mixing as a free iron-based powder in which the alloy powder(s) or the machinability improving powder(s) is not substantially adhered on the surface. When at least a portion of the reduced iron powder is formed as a free iron-based powder, the die filling property of the iron-based mixed powder can be further removed remarkably.

The manufacturing method of the iron-based mixed powder according to this invention is not restricted only to the two examples of the manufacturing methods described above. As an example of the method other than the manufacturing methods described above, for example, after dissolving or dispersing the binder in an organic solvent, the iron-based powder, the alloying powder(s) and, optionally, the machinability improving powder(s), may be mixed and then the organic solvent may be evaporated to adhere the alloying powder(s), and the machinability improving powder(s) to the surface of the iron-based powder (processes up to this step constitute the binder treatment) and then the lubricant may be admixed to form an iron-based mixed powder in which the free lubricant is present.

The binder treatment is not restricted only to the method described above, but all treatments conducted to adhere the starting powder other than the iron-based powder on the surface of the iron-based powder are included in the binder treatment. It is important that a considerable amount of the alloying powder(s) or the machinability improving powder (s) is adhered to the iron-based powder for the effective binder treatment. For example, in a case of a graphite powder added frequently, it is preferred to conduct the binder treatment while selecting such a condition that about 60% or more (mass %) thereof is adhered.

For the iron-based mixed powder according to this invention, any of production process routes in usual powder metallurgy is applicable, such as pressing-sintering, pressing-sintering-carburized quenching (CQT), pressing-sintering-bright quenching (BQT), and pressing-sintering-induction quenching. In all of process route mentioned above, sizing process can be added if necessary.

EXAMPLES

Example 1

At first, 970 g of the iron-based powder, and the binder of the amount shown in TABLE 1, and alloying powders were charged in a heat mixing machine and mixed sufficiently to form mixture.

As the alloying powders, 10 g of a graphite powder with an average particle size of 23 $\mu$m and 20 g of an electrolitic copper powder of an average particle size of 25 $\mu$m were added (the addition amount of the graphite powder is 1.0 mass % and that of the electrolitic copper powder is 2.0 mass %, based on the total amount for the iron-based powder, the alloying powders and the machinability improving powder).

As the iron-based powder, an atomized iron powder (KIP301A and KIP260A, manufactured by Kawasaki Steel Corporation) having the particle size distribution shown in TABLE 5 and, further, a reduced iron powder (KIP255M manufactured by Kawasaki Steel Corporation) were used. Each of them, which is a general iron powder for industrial use, was used after classifying by a sieve and mixing again by a V-blender, so as to provide the particle size distribution shown in TABLE 6. In TABLE 5 and TABLE 6, 0% means less than 0.1%. Further, the atomized iron powder was mixed with the reduced iron powder by the amount shown in TABLE 6 in a particular iron-based powder. Further, an atomized iron powder not classified by the sieve was used in a particular iron-based powder. Further, the apparent density of the iron powder used was measured in accordance with JPMA P06-1992 (Standards of Japan Powder Metallurgy Industry Society) and is shown together in TABLE 5.

Further, as the binder, binders of the type and the amount shown in TABLE 1 were previously mixed and used. The content shown in TABLE 1 is represented by parts by weight based on 100 parts by weight of the total amount for the iron-based powder, the alloying powders and, optionally, the machinability improving powder.

Then, the mixtures were heated while continuing mixing at the temperature shown in TABLE 1 (processes up to this steps are referred to as primary mixing) to form a primary mixture.

Successively, the primary mixture was cooled to 85° C. or lower while mixing. Further, after cooling to 40° C., free lubricants of the kind and the amount shown in TABLE 1 were added and after mixing so as to be homogenized (processes up to this step are referred as secondary mixing), the mixture was discharged from the heat mixing machine to form an iron-based mixed powder. TABLE 3 shows the relation between the symbols and the kinds of the free lubricants other than thermoplastic resin powder, zinc stearate and lithium stearate added during secondary mixing. Further, TABLE 4 shows the relation between the symbols and the kinds of the thermoplastic resin powder used for the secondary mixing, the compositions, the polymerization method, the primary particle size, the agglomeration particle size and the molecular weight thereof.

A reduced iron powder (15 mass %) was added together with the lubricant during secondary mixing in a particular iron-based mixed powder (iron-based mixed powder: No. 1-8).

The die filling property, compressibility, segregation property and apparent density were evaluated for the resultant iron-based mixed powder.

(1) Die Filling Property Test

Die filling property test for the iron-based mixed powder was conducted by using an apparatus schematically shown for the arrangement in FIG. 1. A shoe box (100 mm×60 mm×20 mm) filled with 150 g of an iron-based mixed powder (tested mixed powder) was moved at a speed of 200 mm/s in the direction of a mold, which was stopped just above a mold having a cavity of T=1 mm, kept for 1 second and then retracted after charging the iron-based mixed powder to the mold. After charging, pressing was conducted under a pressure of 480 MPa to form a green compact.

The weight for the green compacts was measured to determine the charged density {=(green compact weight)/(cavity volume)}. The value obtained by dividing the charged density by the apparent density of the iron-based mixed powder in the shoe box was defined as a charged value and the die filling property was evaluated. It shows that die filling property is better as the charged value is greater.

(2) Compressibility Test

Iron-based mixed powder (tested mixed powder) was pressed at a pressure of 5 ton/cm$^2$ (490 MPa) into a tablet of 25 mmϕdia×20 mm height. The density (green density) of the green compact was measured to evaluate the compressibility. The density was evaluated by the Archimedes method.

(3) Segregation Test

Segregation of the graphite powder (a kind of alloying powder) contained in the iron-based mixed powder was investigated to evaluate the segregation property. The iron-based mixed powder (tested mixed powder) was sieved and carbon was quantitatively analyzed for the powder not passing through a sieve of 100 mesh (150 μm) but not passing through 200 mesh (75 μm). Further, quantitative analysis was conducted also for the carbon of the entire iron-based mixed powder (tested mixed powder). From the results, the segregation property was evaluated using the degree of carbon adhesion defined as below.

Degree of carbon adhesion ={C analysis value for iron-based mixed powder with a particle size passing through 100 mesh (150 μm) but not passing through 200 mesh (75 μm)}/(C analysis value for iron-based mixed powder)×100 (mass %).

Larger degree of carbon adhesion means less segregation of the graphite powder in the iron-based mixed powder.

(4) Test for Apparent Density

The apparent density of the iron-based mixed powder (tested mixed powder) was measured in accordance with JPMA P06-1992) (Standards of Japanese Powder Metallurgy Industry Society).

The results are shown TABLE 2.

TABLE 1

| | iron-based powder | | | | | | | | | | | |
|---|---|---|---|---|---|---|---|---|---|---|---|---|
| | atomized iron powder* | | | reduced iron powder* | | iron-based powder particle size distribution*** | | | | | | |
| | | ratio | | | ratio | | (mass %) | | | | | heating |
| iron-based mixed powder | type | based on iron-based powder (mass %) | apparent density (Mg/m$^3$) | type | based on iron-based powder (mass %) | No. | 180 μm or more | less than 180 μm, 150 μm or more | less than 150 μm, 75 μm or more | less than 45 μm | machinability improving powder (mass %) | temperature for primary mixing (° C.) |
| 1-1 | a | 100 | 2.95 | — | — | 1 | 0 | 9.4 | 45.1 | 19.8 | — | 120 |
| 1-2 | b | 100 | 2.66 | — | — | 2 | 1.8 | 9.4 | 48.8 | 17.0 | — | 100 |
| 1-3 | — | — | — | c | 100 | 3 | 0 | 1.5 | 65.9 | 11.5 | — | 135 |
| 1-4 | a | 100 | 2.95 | — | — | 4 | 0 | 9.2 | 40.7 | 26.0 | — | 115 |
| 1-5 | a | 97 | 2.95 | c | 3 | 5 | 0 | 9.2 | 45.8 | 19.6 | — | 130 |
| 1-6 | a | 85 | 2.95 | c | 15 | 6 | 0 | 8.2 | 48.2 | 18.5 | — | 110 |
| 1-7 | a | 75 | 2.95 | c | 25 | 7 | 0 | 7.4 | 50.3 | 17.7 | — | 137 |
| 1-8 | a | 70 | 2.95 | c | 15+ 15* | 8 | 0 | 7.0 | 51.4 | 17.3 | — | 110 |
| 1-9 | a | 70 | 2.95 | c | 30 | 8 | 0 | 7.0 | 51.4 | 17.3 | — | 110 |
| 1-10 | a | 100 | 2.94 | — | — | 9 | 0 | 9.9 | 47.3 | 15.0 | — | 115 |
| 1-11 | a | 100 | 2.93 | — | — | 10 | 0 | 3.7 | 60.1 | 13.8 | — | 130 |
| 1-12 | a | 100 | 2.91 | — | — | 11 | 0 | 2.7 | 62.8 | 12.7 | — | 135 |
| 1-13 | a | 100 | 2.89 | — | — | 12 | 0 | 1.5 | 65.9 | 11.5 | — | 115 |
| 1-14 | a | 100 | 2.94 | — | — | 13 | 6.0 | 3.4 | 46.6 | 18.2 | — | 135 |
| 1-15 | a | 75 | 2.95 | c | 25 | 7 | 0 | 7.4 | 50.3 | 17.7 | — | 100 |
| 1-16 | a | 70 | 2.95 | c | 30 | 8 | 0 | 7.0 | 51.4 | 17.3 | — | 130 |
| 1-17 | a | 70 | 2.95 | c | 30 | 8 | 0 | 7.0 | 51.4 | 17.3 | — | 110 |
| 1-18 | a | 100 | 2.91 | — | — | 11 | 0 | 2.7 | 62.8 | 12.7 | — | 120 |
| 1-19 | b | 70 | 2.66 | c | 30 | 14 | 0 | 7.0 | 51.4 | 17.3 | — | 120 |
| 1-20 | b | 100 | 2.66 | — | — | 15 | 0 | 2.7 | 62.8 | 12.7 | — | 136 |
| 1-21 | a | 100 | 2.86 | — | — | 16 | 0 | 13.1 | 53.3 | 13.3 | — | 120 |
| 1-22 | a | 100 | 2.89 | — | — | 12 | 0 | 1.5 | 65.9 | 11.5 | — | 115 |
| 1-23 | a | 100 | 2.93 | — | — | 17 | 0.3 | 2.6 | 62.6 | 12.7 | — | 130 |

TABLE 1-continued

| iron-based mixed powder | binder: stearic acid mp: 60° C. (parts by weight) | oleamide mp: 76° C. (parts by weight) | stearamide mp: 103° C. (parts by weight) | melted mixture of stearamide and ethylenbis (stearamide) mp: 125° C. (parts by weight) | ethylenbis (stearamide) mp: 147° C. (parts by weight) | total amount *** (parts by weight) | free lubricant: type: content (parts by weight): thermal plastic resin powder type | thermal plastic resin powder content | zinc stearate | lithium stearate | total amount: **** (parts by weight) | type: ***** amount **** (parts by weight) | total amount (parts by weight) |
|---|---|---|---|---|---|---|---|---|---|---|---|---|---|
| 1-1 | — | 0.30 | — | 0.30 | — | 0.60 | — | — | 0.20 | — | 0.20 | — | 0.20 |
| 1-2 | 0.15 | — | 0.30 | — | — | 0.45 | D | 0.15 | — | — | 0.15 | c: 0.10 | 0.25 |
| 1-3 | 0.30 | — | — | — | 0.10 | 0.40 | C | 0.30 | — | — | 0.30 | — | 0.30 |
| 1-4 | — | 0.20 | — | 0.30 | — | 0.50 | G | 0.10 | 0.10 | — | 0.20 | b: 0.30 | 0.50 |
| 1-5 | — | 0.20 | — | — | 0.20 | 0.40 | A | 0.25 | — | 0.15 | 0.40 | — | 0.40 |
| 1-6 | 0.15 | — | — | 0.10 | — | 0.25 | C | 0.15 | — | — | 0.15 | f: 0.20 | 0.35 |
| 1-7 | — | — | — | 0.20 | 0.20 | 0.40 | A | 0.20 | 0.20 | — | 0.40 | — | 0.40 |
| 1-8 | 0.10 | — | 0.10 | 0.40 | — | 0.60 | — | — | — | 0.25 | 0.25 | c: 0.15 | 0.40 |
| 1-9 | — | 0.20 | — | 0.10 | — | 0.30 | B | 0.10 | — | 0.10 | 0.20 | a: 0.15 | 0.35 |
| 1-10 | — | — | 0.30 | — | 0.10 | 0.40 | F | 0.05 | — | — | 0.05 | d: 0.10, e: 0.20 | 0.35 |
| 1-11 | 0.15 | — | — | — | 0.20 | 0.35 | D | 0.15 | — | — | 0.15 | c: 0.10 | 0.25 |
| 1-12 | — | — | — | 0.20 | 0.20 | 0.40 | E | 0.20 | 0.10 | — | 0.30 | — | 0.30 |
| 1-13 | 0.10 | — | — | 0.50 | — | 0.60 | A | 0.2 | — | — | 0.20 | f: 0.20 | .040 |
| 1-14 | — | — | — | 0.20 | 0.20 | 0.40 | A | 0.10 | 0.20 | — | 0.30 | — | 0.30 |
| 1-15 | — | 0.05 | — | — | — | 0.05 | C | 0.20 | 0.05 | — | 0.25 | d: 0.10, e: 0.20 | 0.55 |
| 1-16 | 0.80 | — | — | — | 0.40 | 1.20 | B | 0.20 | 0.05 | — | 0.25 | c: 0.15 | 0.40 |
| 1-17 | 0.20 | 0.30 | — | 0.30 | — | 0.80 | F | 0.05 | — | — | 0.05 | — | 0.05 |
| 1-18 | 0.20 | — | — | — | 0.30 | 0.50 | A | 0.20 | — | — | 0.20 | f: 0.80 | 1.00 |
| 1-19 | — | — | 0.10 | 0.30 | — | 0.40 | — | — | — | 0.25 | 0.25 | c: 0.15 | 0.40 |
| 1-20 | — | — | 0.20 | 0.10 | 0.10 | 0.40 | B | 0.10 | — | 0.10 | 0.20 | a: 0.15 | 0.35 |
| 1-21 | 0.20 | — | — | — | 0.30 | 0.50 | A | 0.20 | 0.20 | — | 0.40 | — | 0.40 |
| 1-22 | — | — | 0.05 | — | 0.03 | 0.08 | A | 0.10 | — | — | 0.10 | f: 0.10 | 0.20 |
| 1-23 | 0.10 | 0.05 | 0.10 | 0.10 | — | 0.35 | D | 0.15 | — | — | 0.15 | c: 0.10 | 0.25 |

note
*) refer to TABLE 5
**) free iron-based powder, alloying powders: graphite powder: 1.0 mass %, copper powder 2.0 mass %
***) refer to TABLE 6
****) parts by weight to the total amount of 100 parts by weight for iron-based powder, alloying powders and machinability improving powder.
*****) refer to TABLE 3

TABLE 2

| iron-based mixed powder No. | iron-based mixed powder characteristic: die filling property charged value | apparent density of iron-based mixed powder ($Mg/m^3$) | compressibility green density ($Mg/m^3$) | segregation property carbon depositing degree (%) | remarks |
|---|---|---|---|---|---|
| 1-1 | 0.30 | 3.32 | 6.89 | 85 | comparative example |
| 1-2 | 0.32 | 2.84 | 6.85 | 84 | comparative example |
| 1-3 | 0.86 | 2.92 | 6.78 | 84 | comparative example |
| 1-4 | 0.32 | 3.35 | 6.89 | 86 | comparative example |
| 1-5 | 0.45 | 3.38 | 6.89 | 87 | comparative example |
| 1-6 | 0.80 | 3.30 | 6.87 | 85 | invention |
| 1-7 | 0.82 | 3.28 | 6.86 | 86 | invention |
| 1-8 | 0.82 | 3.27 | 6.86 | 86 | invention |
| 1-9 | 0.82 | 3.31 | 6.85 | 83 | invention |

TABLE 2-continued

| iron-based mixed powder No. | iron-based mixed powder characteristic: die filling property charged value | apparent density of iron-based mixed powder ($Mg/m^3$) | compressibility green density ($Mg/m^3$) | segregation property carbon depositing degree (%) | remarks |
|---|---|---|---|---|---|
| 1-10 | 0.80 | 3.34 | 6.88 | 87 | invention |
| 1-11 | 0.87 | 3.35 | 6.89 | 86 | invention |
| 1-12 | 0.86 | 3.30 | 6.89 | 85 | invention |
| 1-13 | 0.87 | 3.29 | 6.89 | 89 | invention |
| 1-14 | 0.41 | 3.35 | 6.88 | 87 | comparative example |
| 1-15 | 0.82 | 3.15 | 6.86 | 32 | comparative example |
| 1-16 | 0.69 | 3.20 | 6.85 | 85 | invention |
| 1-17 | 0.50 | 3.15 | 6.85 | 86 | invention |
| 1-18 | 0.65 | 3.25 | 6.83 | 84 | invention |
| 1-19 | 0.32 | 2.85 | 6.86 | 86 | comparative example |
| 1-20 | 0.29 | 2.93 | 6.85 | 83 | comparative example |
| 1-21 | 0.42 | 2.95 | 6.84 | 86 | comparative example |
| 1-22 | 0.84 | 3.30 | 6.86 | 65 | invention |
| 1-23 | 0.83 | 3.35 | 6.86 | 85 | invention |

TABLE 3

| symbol | type |
|---|---|
| a | stearic acid |
| b | oleamide |
| c | stearamide |
| d | melted mixture of stearamide and ethylenbis(stearamide) |

TABLE 3-continued

| symbol | type |
|---|---|
| e | ethylenbis(stearamide) |
| f | melted mixture of ethylenbis(stearamide) and polyethylene with molecular weight of 10,000 or less |

TABLE 4

| symbol for thermal plastic resin powder | manufacturing condition of thermal plastic resin powder: composition* | compositional ratio (wt %) | polymerization method | property of thermoplastic resin powder: average molecular weight ($10^4$) | primary particle size ($\mu m$) | agglomeration particle size ($\mu m$) |
|---|---|---|---|---|---|---|
| A | MMA | 100 | copolymerization | 40 | 0.04 | 30 |
| B | BA/MMA | 60/40 | core/shell two step polymerization | 200 | 1 | 40 |
| C | ST/BMA | 70/30 | copolymerization | 300 | 3 | 25 |
| D | MMA/BD | 85/15 | copolymerization | 80 | 0.08 | 15 |
| E | MMM/BMA | 70/30 | copolymerization | 60 | 0.4 | 30 |
| F | ST/AN | 80/20 | copolymerization | 100 | 0.3 | 20 |
| G | EA/ST | 60/40 | core/shell two step polymerization | 250 | 0.1 | 15 |

note *)
MMA: methyl methacrylate
BMA: n-butyl methacrylate
EA: ethyl acrylate
BA: n-butyl acrylate
AN: acrylonitrile
BD: butadiene
ST: styrene

TABLE 5

| iron powder type | particle size distribution (mass %) unit: μm 180 or more | less than 180 - 150 or more | less than 150 - 106 or more | less than 106 - 75 or more | less than 75 - 63 or more | less than 63 - 45 or more | less than 45 | total | apparent density Mg/m³ | | remarks |
|---|---|---|---|---|---|---|---|---|---|---|---|
| a | 0 | 9.4 | 18.2 | 26.9 | 9.9 | 15.8 | 19.8 | 100 | 2.95 | KIP 301A | atomized iron |
| b | 1.8 | 9.4 | 22.4 | 26.4 | 9.9 | 13.1 | 17.0 | 100 | 2.66 | KIP 260A | powder |
| c | 0 | 1.5 | 30.5 | 35.4 | 9.8 | 11.3 | 11.5 | 100 | 2.55 | KIP 255M | reduced iron powder |

TABLE 6

| iron-based powder No. | atomized iron powder type | atomized iron powder content (mass %) | reduced iron powder type | reduced iron powder content (mass %) | particle size distribution (mass %) unit: μm 180 or more | less than 180 - 150 or more | less than 150 - 106 or more | less than 106 - 75 or more | less than 75 - 63 or more | less than 63 - 45 or more | less than 45 | total |
|---|---|---|---|---|---|---|---|---|---|---|---|---|
| 1 | a | 100 | — | — | 0 | 9.4 | 18.2 | 26.9 | 9.9 | 15.8 | 19.8 | 100 |
| 2 | b | 100 | — | — | 1.8 | 9.4 | 22.4 | 26.4 | 9.9 | 13.1 | 17.0 | 100 |
| 3 | — | — | c | 100 | 0 | 1.5 | 30.5 | 35.4 | 9.8 | 11.3 | 11.5 | 100 |
| 4 | a | 100 | — | — | 0 | 9.2 | 17.2 | 23.5 | 9.8 | 14.3 | 26.0 | 100 |
| 5 | a | 93 | c | 7 | 0 | 9.2 | 18.6 | 27.2 | 9.9 | 15.7 | 19.6 | 100 |
| 6 | a | 85 | c | 15 | 0 | 8.2 | 20.0 | 28.2 | 9.9 | 15.2 | 18.5 | 100 |
| 7 | a | 75 | c | 25 | 0 | 7.4 | 21.3 | 29.0 | 9.9 | 14.7 | 17.7 | 100 |
| 8 | a | 70 | c | 30 | 0 | 7.0 | 21.9 | 29.5 | 9.9 | 14.5 | 17.3 | 100 |
| 9 | a | 100 | — | — | 0 | 9.9 | 19.1 | 28.2 | 10.4 | 16.6 | 15.0 | 100 |
| 10 | a | 100 | — | — | 0 | 3.7 | 27.1 | 33.0 | 9.8 | 12.6 | 13.8 | 100 |
| 11 | a | 100 | — | — | 0 | 2.7 | 28.7 | 34.1 | 9.8 | 12.0 | 12.7 | 100 |
| 12 | a | 100 | — | — | 0 | 1.5 | 30.5 | 35.4 | 9.8 | 11.3 | 11.5 | 100 |
| 13 | a | 100 | — | — | 6 | 3.4 | 26.3 | 20.3 | 9.8 | 16.0 | 18.2 | 100 |
| 14 | b | 70 | c | 30 | 0 | 7.0 | 21.9 | 29.5 | 9.9 | 14.5 | 17.3 | 100 |
| 15 | b | 100 | — | — | 0 | 2.7 | 28.7 | 34.1 | 9.8 | 12.0 | 12.7 | 100 |
| 16 | a | 100 | — | — | 0 | 13.1 | 25.9 | 27.4 | 9.6 | 10.7 | 13.3 | 100 |
| 17 | a | 100 | — | — | 0.3 | 2.6 | 28.6 | 34.0 | 9.8 | 12.0 | 12.7 | 100 |

It can be seen that each of the Examples according to preferable conditions of this invention (iron-based mixed powders Nos. 1-6 to 1-13, No. 1-23) have excellent compressibility and die filling property, a green density of 6.85 Mg/m$^3$ or more, a degree of carbon adhesion of 80% or more, a charged value of 0.8 or more and an apparent density of 3.1 Mg/m$^3$ or more. Particularly, the iron-based mixed powder in which the particles with a particle size of less than 45 μm are restricted to less than 15.0 mass % (Nos. 1-11 to 1-13, No. 1-23) show particularly excellent die filling property. Further, iron-based mixed powder in which particles with a particle size of less than 45 μm are restricted to less than 12.7 mass % (No. 1-13) shows extremely excellent die filling property although the segregation is extremely small.

Iron-based mixed powder of this invention in less preferable conditions (Nos. 1-16 to 1-18, No. 1-22) still has good die filling properties and compressibility, with less segregation of graphite powder, although somewhat lower than that in preferable conditions.

In the iron-based mixed powder in which the amount of the binder is lower than the preferred range of this invention (No. 1-22), segregation tends to increase somewhat. Further, in the iron-based mixed powder in which the amount of the binder is more than the preferred range of this invention (No. 1-16), the die filling property was lower. Further, in the iron-based mixed powder in which the amount of the free lubricant is less than the preferred range of this invention (No. 1-17), the die filling property was lowered. Further, in the iron-based mixed powder in which the amount of the free lubricant is much greater than the preferred range of this invention (No. 1-18), the die filling property was lowered.

In the iron-based mixed powder in which the amount of the binder is remarkably insufficient and the purpose of the binder treatment can not be attained (No. 1-15), the alloying powders are not sufficiently adhered on the iron powder actually and, as a result, prevention of segregation is poor.

In the Comparative Examples in which the particle size distribution is outside of the range of this invention (iron-based mixed powder Nos. 1-1, 1-2, 1-4, 1-5, 1-14 and 1-21), the die filling property was lowered. Further, in the comparative example using only the reduced iron powder as the iron-based powder (iron-based mixed powder No. 1-3), the compressibility is lowered although the die filling property is excellent. Further, in the Comparative Examples in which the apparent density of the atomized iron powder used is lower than the range of this invention (iron-based mixed powders Nos. 1-19 and 1-20), the apparent density of the iron-based mixed powder was as low as 3.1 Mg/m$^3$ and the die filling property is lowered.

Example 2

Primary mixing was conducted by spraying one or more members selected from oleic acid, spindle oil and turbine oil shown in TABLE 7 as a binder to 974 g of an iron-based powder, 6 g of a graphite powder having an average particle size of 23 μm and 20 g of an electrolitic copper powder having an average particle size of 25 μm as the alloying powders, and then mixing them.

As the iron-based powder, an atomized iron powder (KIP301A, KIP260A, manufactured by Kawasaki Steel Corporation) having the particle size distribution shown in TABLE 5 and, further a reduced iron powder (KIP255M, manufactured by Kawasaki Steel Corporation) were used. The atomized iron powder was used after being classified by the sieve and then mixed again by a V-blender so as to provide the particle size distribution as shown in TABLE 6. Further, a reduced iron powder was mixed in an amount shown in TABLE 6 to the atomized iron powder in a certain iron-based powder and, further, an atomized iron powder not subjected to classification by the sieve was used in a particular iron-based powder. Further, the apparent density of the iron powder used was measured in accordance with JPMA P06-1992 (Standards of Japanese Powder Metallurgy Industry Society) and shown together in TABLE 5.

In the iron-based mixed powder No. 2-10, 4 g of an MnS powder with an average particle size of 20 μm was blended as machinability improving powder to 970 g of an iron/based powder, 20 g of a copper powder and 6 g of a graphite powder.

Then, zinc stearate was further added by an amount shown in TABLE 7 as a binder to the primarily mixed powder and they were charged in a heat mixing machine and mixed thoroughly to form a mixture. The mixture was heated under mixing to the temperature shown in TABLE 7 to form a secondary mixture.

Successively, the secondary mixture was cooled while mixing to 85° C. or lower. Further, after cooling to 40° C. the free lubricant of the type and the amount shown in TABLE 7 was added and subjected to tertiary mixing so as to provide a homogeneous state and then discharged from the heat mixing machine to form an iron-based mixed powder. TABLE 3 shows, like Example 1, the relation between the symbols and the kinds of free lubricants other than the thermoplastic resin powder, zinc stearate and lithium stearate added upon tertiary mixing. Further, TABLE 4 shows, like Example 1, the relation between the symbols and the kinds of the thermoplastic resin powders used for tertiary mixing, compositions, polymerization methods, primary particle size, agglomeration particle size and the molecular weight thereof. A reduced iron powder (25 mass %) was added together with the free lubricant upon secondary mixing in a particular experiment (iron-based mixed powder No. 2-7).

For the resultant iron-based mixed powder, die filling property, compressibility, segregation property and apparent density were evaluated in the same test method as in Example 1.

The obtained results are shown in TABLE 8.

TABLE 7

| | iron-based powder | | | | | | | | | | | |
|---|---|---|---|---|---|---|---|---|---|---|---|---|
| | atomized iron powder* | | | reduced iron powder* | | iron-based powder particle size distribution*** (mass %) | | | | | | |
| | | ratio | | | ratio | | | | | | | heating |
| iron-based mixed powder | Type | based on iron-based powder (mass %) | apparent density (Mg/m³) | type | based on iron-based powder (mass %) | No. | 180 μm or more | less than 180 μm, 150 μm or more | less than 150 μm, 75 μm or more | less than 45 μm | machinability improving powder (mass %) | temperature for secondary mixing (° C.) |
| 2-1 | a | 100 | 2.95 | — | — | 1 | 0 | 9.4 | 45.1 | 19.8 | — | 135 |
| 2-2 | b | 100 | 2.66 | — | — | 2 | 1.8 | 9.4 | 48.8 | 17.0 | — | 140 |
| 2-3 | — | — | — | c | 100 | 3 | 0 | 1.5 | 65.9 | 11.5 | — | 135 |
| 2-4 | a | 100 | 2.95 | — | — | 4 | 0 | 9.2 | 40.7 | 26.0 | — | 140 |
| 2-5 | a | 97 | 2.95 | c | 3 | 5 | 0 | 9.2 | 45.8 | 19.6 | — | 135 |
| 2-6 | a | 85 | 2.95 | c | 15 | 6 | 0 | 8.2 | 48.2 | 18.5 | — | 140 |
| 2-7 | a | 74 | 2.95 | c | 25** | 7 | 0 | 7.4 | 50.3 | 17.7 | — | 135 |
| 2-8 | a | 75 | 2.95 | c | 25 | 7 | 0 | 7.4 | 50.3 | 17.7 | — | 140 |
| 2-9 | a | 70 | 2.95 | c | 30 | 8 | 0 | 7.0 | 51.4 | 17.3 | — | 135 |
| 2-10 | a | 70 | 2.95 | c | 30 | 8 | 0 | 7.0 | 51.4 | 17.3 | 0.4 | 140 |
| 2-11 | a | 100 | 2.94 | — | — | 9 | 0 | 9.9 | 47.3 | 15.0 | — | 135 |
| 2-12 | a | 100 | 2.94 | — | — | 9 | 0 | 9.9 | 47.3 | 15.0 | — | 140 |
| 2-13 | a | 100 | 2.93 | — | — | 10 | 0 | 3.7 | 60.1 | 13.8 | — | 135 |
| 2-14 | a | 100 | 2.93 | — | — | 10 | 0 | 3.7 | 60.1 | 13.8 | — | 140 |
| 2-15 | a | 100 | 2.91 | — | — | 11 | 0 | 2.7 | 62.8 | 12.7 | — | 135 |
| 2-16 | a | 100 | 2.91 | — | — | 11 | 0 | 2.7 | 62.8 | 12.7 | — | 140 |
| 2-17 | a | 100 | 2.89 | — | — | 12 | 0 | 1.5 | 65.9 | 11.5 | — | 135 |
| 2-18 | a | 100 | 2.94 | — | — | 13 | 6.0 | 3.4 | 46.6 | 18.2 | — | 140 |
| 2-19 | a | 75 | 2.95 | c | 25 | 7 | 0 | 7.4 | 50.3 | 17.7 | — | 135 |
| 2-20 | a | 70 | 2.95 | c | 30 | 8 | 0 | 7.0 | 51.4 | 17.3 | — | 140 |
| 2-21 | a | 70 | 2.96 | c | 30 | 8 | 0 | 7.0 | 51.4 | 17.3 | — | 135 |
| 2-22 | a | 100 | 2.91 | — | — | 11 | 0 | 2.7 | 62.8 | 12.7 | — | 140 |
| 2-23 | b | 70 | 2.66 | c | 30 | 14 | 0 | 7.0 | 51.4 | 17.3 | — | 135 |
| 2-24 | b | 100 | 2.66 | — | — | 15 | 0 | 2.7 | 62.8 | 12.7 | — | 140 |

TABLE 7-continued

| iron-based mixed powder | binder: oleic acid (parts by weight) | binder: spindle oil (parts by weight) | binder: turbine oil (parts by weight) | binder: zinc stearate (parts by weight) | total amount **** (parts by weight) | free lubricant: type: content (parts by weight): thermal plastic resin powder type | free lubricant: type: content (parts by weight): thermal plastic resin powder content | free lubricant: type: content (parts by weight): zinc stearate | free lubricant: type: content (parts by weight): lithium stearate | total amount: **** (parts by weight) | type: ***** amount **** (parts by weight) | total amount **** (parts by weight) |
|---|---|---|---|---|---|---|---|---|---|---|---|---|
| 2-1 | 0.05 | — | — | 0.30 | 0.35 | — | — | 0.35 | — | 0.35 | — | 0.35 |
| 2-2 | 0.09 | — | — | 0.30 | 0.39 | — | — | 0.40 | — | 0.40 | — | 0.40 |
| 2-3 | — | 0.08 | — | 0.40 | 0.48 | G | 0.20 | — | — | 0.20 | — | 0.20 |
| 2-4 | — | — | 0.10 | 0.35 | 0.45 | C | 0.10 | 0.10 | — | 0.20 | b: 0.30 | 0.50 |
| 2-5 | 0.10 | — | — | 0.50 | 0.60 | A | 0.25 | — | 0.15 | 0.40 | — | 0.40 |
| 2-6 | 0.15 | — | — | 0.40 | 0.55 | C | 0.15 | — | — | 0.15 | f: 0.20 | 0.35 |
| 2-7 | 0.09 | — | — | 0.30 | 0.39 | — | — | 0.40 | — | 0.40 | — | 0.40 |
| 2-8 | — | — | 0.12 | 0.40 | 0.52 | A | 0.20 | 0.20 | — | 0.40 | — | 0.40 |
| 2-9 | — | 0.09 | — | 0.35 | 0.44 | — | — | — | 0.25 | 0.25 | c: 0.15 | 0.40 |
| 2-10 | — | — | 0.15 | 0.60 | 0.75 | B | 0.10 | — | 0.10 | 0.20 | a: 0.15 | 0.35 |
| 2-11 | 0.08 | — | — | 0.80 | 0.88 | F | 0.05 | — | — | 0.05 | d: 0.10, e: 0.20 | 0.35 |
| 2-12 | — | — | 0.12 | 0.35 | 0.47 | G | 0.20 | 0.20 | — | 0.40 | — | 0.40 |
| 2-13 | — | 0.06 | — | 0.40 | 0.46 | C | 0.10 | 0.10 | — | 0.20 | b: 0.30 | 0.50 |
| 2-14 | — | 0.06 | — | 0.40 | 0.46 | D | 0.15 | — | — | 0.15 | c: 0.10 | 0.25 |
| 2-15 | — | — | 0.10 | 0.30 | 0.40 | E | 0.20 | 0.10 | — | 0.30 | — | 0.30 |
| 2-16 | 0.07 | — | — | 0.40 | 0.47 | — | — | 0.35 | — | 0.35 | — | 0.35 |
| 2-17 | 0.12 | — | — | 0.25 | 0.37 | A | 0.20 | — | — | 0.20 | f: 0.20 | 0.40 |
| 2-18 | — | 0.10 | — | 0.30 | 0.40 | B | 0.10 | 0.20 | — | 0.30 | — | 0.30 |
| 2-19 | 0.02 | — | — | 0.02 | 0.04 | C | 0.20 | 0.05 | — | 0.25 | d: 0.10, e: 0.20 | 0.55 |
| 2-20 | 0.05 | — | — | 1.15 | 1.20 | B | 0.20 | 0.05 | — | 0.25 | c: 0.15 | 0.40 |
| 2-21 | 0.20 | 0.30 | — | 0.30 | 0.80 | F | 0.05 | — | — | 0.05 | — | 0.05 |
| 2-22 | 0.20 | — | — | — | 0.20 | A | 0.20 | — | — | 0.20 | f: 0.80 | 1.00 |
| 2-23 | — | 0.09 | — | 0.35 | 0.44 | — | — | — | 0.25 | 0.25 | c: 0.15 | 0.40 |
| 2-24 | — | — | 0.15 | 0.60 | 0.75 | B | 0.10 | — | 0.10 | 0.20 | a: 0.15 | 0.05 |

note
*) refer to TABLE 5
**) free iron-based powder, alloying powders: graphite powder: 1.0 mass %, copper powder 2.0 mass %
***) refer to TABLE 6
****) parts by weight to the total amount of 100 parts by weight for iron-based powder, alloying powders and machinability improving powder.
*****) refer to TABLE 3

TABLE 8

| iron-based mixed powder No. | iron-based mixed powder characteristic: die filling property charged value | iron-based mixed powder characteristic: apparent density of iron-based powder ($Mg/m^3$) | iron-based mixed powder characteristic: compressibility green density ($Mg/m^3$) | iron-based mixed powder characteristic: segregation property carbon depositing degree (%) | remarks |
|---|---|---|---|---|---|
| 2-1 | 0.31 | 3.30 | 6.90 | 85 | comparative example |
| 2-2 | 0.35 | 2.80 | 6.86 | 86 | comparative example |
| 2-3 | 0.85 | 2.86 | 6.78 | 84 | comparative example |
| 2-4 | 0.35 | 3.41 | 6.88 | 86 | comparative example |
| 2-5 | 0.36 | 3.40 | 6.88 | 87 | comparative example |
| 2-6 | 0.80 | 3.32 | 6.87 | 85 | invention |
| 2-7 | 0.82 | 3.31 | 6.86 | 86 | invention |
| 2-8 | 0.82 | 3.30 | 6.86 | 85 | invention |
| 2-9 | 0.82 | 3.29 | 6.86 | 86 | invention |
| 2-10 | 0.82 | 3.35 | 6.85 | 83 | invention |
| 2-11 | 0.80 | 3.31 | 6.88 | 87 | invention |
| 2-12 | 0.80 | 3.32 | 6.89 | 87 | invention |
| 2-13 | 0.86 | 3.26 | 6.89 | 86 | invention |
| 2-14 | 0.87 | 3.31 | 6.90 | 86 | invention |
| 2-15 | 0.86 | 3.18 | 6.89 | 85 | invention |

TABLE 8-continued

| iron-based mixed powder No. | iron-based mixed powder characteristic: die filling property charged value | apparent density of iron-based powder ($Mg/m^3$) | compressibility green density ($Mg/m^3$) | segregation property carbon depositing degree (%) | remarks |
|---|---|---|---|---|---|
| 2-16 | 0.85 | 3.45 | 6.90 | 84 | invention |
| 2-17 | 0.87 | 3.32 | 6.88 | 89 | invention |
| 2-18 | 0.41 | 3.24 | 6.90 | 87 | comparative example |
| 2-19 | 0.82 | 3.15 | 6.86 | 38 | comparative example |
| 2-20 | 0.68 | 3.20 | 6.85 | 84 | invention |
| 2-21 | 0.55 | 3.16 | 6.85 | 85 | invention |
| 2-22 | 0.70 | 3.29 | 6.82 | 86 | invention |
| 2-23 | 0.35 | 2.82 | 6.83 | 86 | comparative example |
| 2-24 | 0.30 | 2.86 | 6.84 | 83 | comparative example |

Each of the Examples according to preferable conditions of this invention (iron-based mixed powder: Nos. 2-6 to 2-17) had excellent compressibility and die filling property, a green density of 6.85 $Mg/m^3$ or more, a degree of carbon adhesion of 80% or more, a charged value of 0.8 or more and an apparent density of 3.1 $Mg/m^3$ or more. Particularly, the iron-based mixed powders in which the particles of the particle size of less than 45 $\mu$m are restricted to less than 15.0 mass % (Nos. 2-15 to 2-17) showed particularly excellent die filling property. Further, the iron-based mixed powder in which the particles with the particle size of less than 45 $\mu$m are restricted to less than 12.7 mass % (No. 2-17) showed excellent die filling property in spite of extremely small segregation.

Iron-based mixed powder of this invention in less preferable conditions (Nos. 2-20 to 2-22) still has good die filling properties and compressibility, with less segregation of graphite powder, although somewhat lower than that in preferable conditions.

In the iron-based mixed powder in which the amount of the binder was much more than the preferred range of this invention (No. 2-20), the die filling property was lower. Further, in the iron-based mixed powder in which the amount of the free lubricant was less than the preferred range of this invention (No. 2-21), the die filling property was lower. Further, in the iron-based mixed powder in which the amount of the free lubricant was much greater than the preferred range of this invention (No. 2-22), the die filling property was lower.

In the iron-based mixed powder in which the purpose of the binder treatment was not attained due to significant insufficiency for the amount of the binder (No. 2-19), the alloying powders were not sufficiently adhered to the iron powder and prevention of segregation was insufficient.

In the Comparative Examples in which the particle size distribution was outside of the range of this invention (iron-based mixed powders Nos. 2-1, 2-2, 2-4, 2-5 and 2-18), the die filling property was lowered. Further, in the Comparative Example using only the reduced iron powder as the iron-based powder (iron-based mixed powder No. 2-3), the compressibility was lowered although the die filling property was excellent. Further, in the Comparative Examples in which the apparent density of the atomized iron powder used was lower than the range of this invention (iron-based mixed powders Nos. 2-23 and 2-24), the apparent density of the iron-based mixed powder was as low as 3.1 $Mg/m^3$ or less and the die filling property was lowered.

According to this invention, an iron-based mixed powder with less segregation, excellent in the compressibility and also excellent in the die filling property can be manufactured at a reduced cost. Then, the iron-based mixed powder according to this invention can provide outstanding industrial effects capable of coping with the size reduction of sintered parts, and capable of producing sintered parts of high density stably and with less fluctuation of characteristics even when green compacts are produced by using a mold having a narrow width cavity.

What is claimed is:

1. An iron-based mixed powder for use in powder metallurgy having an apparent density of at least about 3.1 $Mg/m^3$,comprising:

an iron-based powder;

at least one alloying powder;

binder; and optionally, at least one machinability improving powder;

wherein the alloying powder and the machinability improving powder are adhered on the surface of the iron-based powder by the binder;

wherein the iron-based powder comprises an atomized iron powder, or a mixed powder of the atomized iron powder and a reduced iron powder;

wherein the atomized iron powder has an apparent density of at least about 2.85 $Mg/m^3$ wherein the iron-based powder has a maximum particle size of less than about 180 $\mu$m and has a particle size distribution comprising about 18.5 mass % or less of particles with a particle size of less than about 45 $\mu$m, at least about 46 mass % of particles with a particle size of from about 75 $\mu$m to about 150 $\mu$m, and less than about 10 mass % of particles with a particle size of from about 150 $\mu$m to about 180 $\mu$m.

2. The iron-based mixed powder of claim 1, wherein the iron-based powder comprises less than about 15 mass % o f particles having a particle size of less than about 45 $\mu$m.

3. The iron-based mixed powder of claim 1, wherein the iron-based powder comprises less than about 12.7 mass % of particles having a particle size of less than about 45 $\mu$m.

4. The iron-based mixed powder of claim 1, wherein the content of the binder is from about 0.1 parts by weight to about 1.0 parts by weight based on 100 parts by weight of the total amount for the iron-based powder, the at least one alloying powder and the at least one machinability improving powder.

5. The iron-based mixed powder of claim 1, wherein the binder comprises at least one member selected from the group consisting of stearic acid, oleamide, stearamide, a melted mixture of stearamide and ethylenbis(stearamide) and ethylenbis(stearamide).

6. The iron-based mixed powder of claim 1, wherein the binder comprises zinc stearate and at least one member selected from the group consisting of oleic acid, spindle oil and turbine oil.

7. The iron-based mixed powder of claim 1, wherein the iron-based mixed powder further comprises a free lubricant.

8. The iron-based mixed powder of claim 7, wherein the content of the free lubricant is from about 0.1 parts by weight to about 0.5 parts by weight or less based on 100 parts by weight of the total amount of the iron-based powder, the at least one alloying powder and the at least one machinability improving powder.

9. The iron-based mixed powder of claim 7, wherein the free lubricant comprises at least one member selected from the group consisting of a thermoplastic resin powder, zinc stearate and lithium stearate and, optionally, at least one member selected from the group consisting of stearic acid, oleamide, stearamide, a melted mixture of stearamide and ethylenbis(stearamide), ethylenbis(stearamide), polyethylene with a molecular weight of about 10,000 or less, and a melted mixture of ethylenbis(stearamide) and polyethylene with a molecular weight of about 10,000 or less.

10. The iron-based mixed powder of claim 9, wherein the thermoplastic resin powder comprises at least about 50 mass % with the thermoplastic resin powder of units of at least one monomer selected from the group consisting of acrylic esters, methacrylic esters, aromatic vinyl compounds and combinations thereof, wherein the monomer is polymerized, and wherein the thermoplastic resin powder has an average primary particle size of from about 0.03 $\mu$m to about 5.0 $\mu$m, an average agglomeration particle size of from about 5 $\mu$m to about 50 $\mu$m, and an average molecular weight measured by the specific viscosity of a solution of from about 30,000 to about 5,000,000.

11. An iron-based mixed powder for use in powder metallurgy having an apparent density of at least about 3.1 $Mg/m^3$, comprising:

an iron-based powder;

at least one alloying powder;

binder, and optionally, at least one machinability improving powder, each being a starting material;

wherein the iron-based powder comprises one of an atomized iron powder and a mixed powder of the atomized iron powder and a reduced iron powder, wherein the atomized iron powder has an apparent density of at least about 2.85 $Mg/m^3$;

wherein the iron-based powder has a maximum particle size of less than 180 $\mu$m, and has a particle size distribution comprising about 18.5 mass % or less of particles with a particle size of less than about 45 $\mu$m, at least about 46 mass % of particles with a particle size of from about 75 $\mu$m to about 150 $\mu$m, and less than about 10 mass % of particles having a particle size of from about 150 $\mu$m to about 180 $\mu$m; and wherein the alloying powder and the machinability improving powder are binder treated with the iron-based powder.

12. The iron-based mixed powder of claim 11, wherein the iron-based mixed powder further comprises free lubricant.

* * * * *